US005917509A

United States Patent [19]

Becerra et al.

[11] Patent Number: 5,917,509

[45] Date of Patent: Jun. 29, 1999

[54] METHOD AND APPARATUS FOR INTERLEAVING PULSES IN A LIQUID RECORDER

[75] Inventors: Juan J. Becerra, Webster; Thomas P. Courtney; Richard L. LaDonna, both of Fairport; Thomas A. Tellier, Wolcott; Thomas E. Watrobski, Penfield; Thomas J. Wyble, Webster, all of N.Y.

[73] Assignee: Xerox Corporation, Stamford, Conn.

[21] Appl. No.: 08/864,893

[22] Filed: May 29, 1997

Related U.S. Application Data

[63] Continuation of application No. 08/401,109, Mar. 8, 1995, abandoned.

[51] Int. Cl.[6] ..... B41J 29/38; B41J 2/05

[52] U.S. Cl. ..... 347/11; 347/12; 347/60

[58] Field of Search ..... 347/11, 12, 13, 347/60, 182, 186, 10, 17, 40, 42

[56] References Cited

U.S. PATENT DOCUMENTS

| | | | |
|---|---|---|---|
| 4,774,530 | 9/1988 | Hawkins | 347/63 |
| 4,982,199 | 1/1991 | Dunn | 347/15 |
| 5,138,337 | 8/1992 | Ng | 347/237 |
| 5,172,134 | 12/1992 | Kishida et al. | 347/13 |
| 5,265,315 | 11/1993 | Hoisington et al. | 29/890.1 X |

FOREIGN PATENT DOCUMENTS

| | | |
|---|---|---|
| 0 496 525 A1 | 7/1992 | European Pat. Off. . |
| 0 505 154 A2 | 9/1992 | European Pat. Off. . |
| 0 630 751 | 6/1994 | European Pat. Off. . |
| 0 698 492 | 8/1995 | European Pat. Off. . |

*Primary Examiner*—David F. Yockey
*Attorney, Agent, or Firm*—Oliff & Berridge, PLC

[57] ABSTRACT

A liquid recording apparatus ejects droplets of liquid onto a recording medium. The apparatus has multiple liquid emitters whose emissions are activated by multiple power pulses. The power pulses are controlled to maximize the number of emitters which can be simultaneously energized while keeping the instantaneous power usage within prescribed boundaries. The multiple emitters are organized into banks of emitters whose numbers are small enough that all emitters within a bank can receive a correct level of power simultaneously without exceeding capacity of a shared power source. A circuit interleaves the power pulses to the emitters so that no bank of emitters are receiving power at the same instant of time.

25 Claims, 12 Drawing Sheets

METHOD AND APPARATUS FOR INTERLEAVING PULSES IN A LIQUID RECORDER

This is a Continuation of application Ser. No. 08/401,109 filed Mar. 8, 1995, now abandoned.

BACKGROUND OF THE INVENTION

1. Field of the Invention

The present invention relates to a liquid recorder apparatus and method utilizing multiple power pulses to eject liquid from multiple emitters. In particular, the present invention relates to an apparatus and method for interleaving in time the power pulses directed to the emitters.

2. Description of Related Art

A thermal ink jet printhead selectively ejects droplets of ink from a plurality of drop emitters to create a desired image on an image receiving member, such as a sheet of paper. The printhead typically comprises an array of the drop emitters that convey ink to the image receiving member. In a carriage-type ink jet printhead, the printhead moves back and forth relative to the image receiving member to print the image in swaths. Alternatively, the array may extend across the entire width of the image receiving member to form a full-width printhead. Full-width printheads remain stationary as the image receiving member moves in a direction substantially perpendicular to the array of drop emitters.

An ink jet printhead typically comprises a plurality of ink passageways, such as capillary channels. Each channel has a nozzle and is connected to an ink supply manifold. Ink from the manifold is retained within each channel until, in response to an appropriate signal applied to a resistive heating element in each channel, the ink and a portion of the channel adjacent to the heating element is rapidly heated and vaporized. Rapid vaporization of some of the ink in the channel creates a bubble that causes a quantity of ink (an ink droplet or a main ink droplet and smaller satellite drops) to be ejected from the emitter to the image receiving member. U.S. Pat. No. 4,774,530 to Hawkins, the disclosure of which is incorporated herein by reference, shows a general configuration of a typical ink jet printhead.

U.S. Pat. No. 4,982,119 to Dunn, the disclosure of which is incorporated herein by reference, discloses a method and apparatus for gray scale printing with a thermal ink jet pen. A firing resistor is driven by a plurality of pulses to eject a droplet of ink from a nozzle. Prewarming of the ink in the firing chamber is achieved by applying an electrical warming pulse signal to the resistor prior to a firing pulse signal. The firing pulse signal causes the drop to be ejected. The warming pulse may be a plurality of pulses applied sequentially prior to the firing pulse and transfers a desired quantity of thermal energy to the ink. The prewarming of the ink by the warming pulse or pulses increases the volume of the ink droplet. By varying the degree of prewarming, the droplets ejected by the firing pulse can be varied in volume, yielding gray scale printing.

European Patent Application No. 0 496 525 A1, the disclosure of which is incorporated herein by reference, discloses an ink jet recording method and apparatus in which ink is ejected by thermal energy produced by a heat generating element of a recording head. According to one aspect, driving means apply plural driving signals to the heat generating element for every ink droplet ejected. The plural driving signals include a first driving signal for increasing a temperature of the ink adjacent the heater without creating the bubble, and a second driving signal subsequent to the first driving signal with an interval therebetween, for ejecting the ink. Additionally, a width of the first driving signal is adjustable so as to change an amount of the ejected ink.

European Patent Application No. 0 505 154 A2, the disclosure of which is incorporated herein by reference, discloses a thermal ink jet recording method and apparatus which controls an ink ejection quantity by changing driving signals supplied to the recording head on the basis of a variation in temperature of the recording head. A preheat pulse is applied to the ink for controlling ink temperature and is set to a value which does not cause a bubble forming phenomenon in the ink. After a predetermined time interval, a main heat pulse is applied which forms a bubble in the ink to cause ejection of a droplet (or a main droplet and satellite drops) of ink from an ejection port.

All of the above patents use multiple pulses applied to a heater element to eject a single drop of ink from an ejector (emitter). One or more pulses are used as a prewarming (or precursor) pulse to warm the ink while a subsequent drive pulse is used to eject a drop of ink from an ejector. In such conventional ink jet printers, the precursor and drive pulses are provided sequentially to each of the heater elements or to banks of heater elements. That is, the precursor pulses and driving pulse are applied to a first heater element or bank of heater elements, followed by application of precursor and drive pulses to a second heater element or bank of heater elements, and so on. Accordingly, the time necessary to drive an entire printhead of such heater elements will be at least the sum of the durations of all the precursor and drive pulses applied to each of the heater elements or banks of heater elements, plus any relaxation time between the pulses.

In such conventional ink jet printers, the precursor pulses are applied to all of the heater elements of the array whether or not a subsequent drive pulse will be applied to actually eject a drop from each emitter. This procedure uses unnecessary electrical power, warming the printhead even when the data contains few image pixels, such as when printing text and line graphics.

U.S. patent application Ser. No. 08/220,720 to Stephany, the disclosure of which is incorporated herein by reference, discloses a power control system for a printer which has at least one heating element for producing spots. The system includes a thermistor disposed on a printhead which senses the temperature of the printhead. The sensed temperature is used to vary pulses applied to the at least one heating element to maintain a constant spot size.

Accordingly, there is a need to provide a method and apparatus that will enable printing using precursor and drive pulses in a more energy and time efficient manner, allowing faster printing and reduction in waste heat generation.

SUMMARY OF THE INVENTION

This invention therefore provides a method and apparatus for forming an image on a recording medium that interleaves in time pulses supplied to at least a first one of a plurality of emitters with a plurality of pulses supplied to at least a second one of the plurality of emitters. The apparatus includes a power source, a recording head and a control device. The power source supplies the pulses. The recording head includes a plurality of liquid emitters which each selectively emit a drop of liquid onto the recording medium in response to a plurality of the pulses. The control device selectively connects each of the plurality of liquid emitters to the power source to supply the plurality of pulses to the liquid emitters. The plurality of pulses supplied to at least a first one of the emitters are interleaved in time with the of pulses supplied to at least a second one of the emitters. The pulses supplied to each of the liquid emitters typically include at least one precursor pulse, which is used to warm the liquid, and a print pulse, which causes a drop of the liquid to be emitted.

The liquid emitters may be grouped into banks each comprising a plurality of liquid emitters. In this case, the plurality of pulses supplied to the liquid emitters within at least a first one of the banks of liquid emitters are interleaved in time with a plurality of pulses supplied to the liquid emitters within at least a second one of the banks of liquid emitters.

The apparatus may also include data storage latches. The data storage latches hold image data for emitters or banks of emitters which receive the interleaved pulses.

A more complete understanding of the present invention can be obtained by considering the following detailed description in conjunction with the accompanying drawings, wherein like index numerals indicate like parts.

DETAILED DESCRIPTION OF PREFERRED EMBODIMENTS

Figure 1:
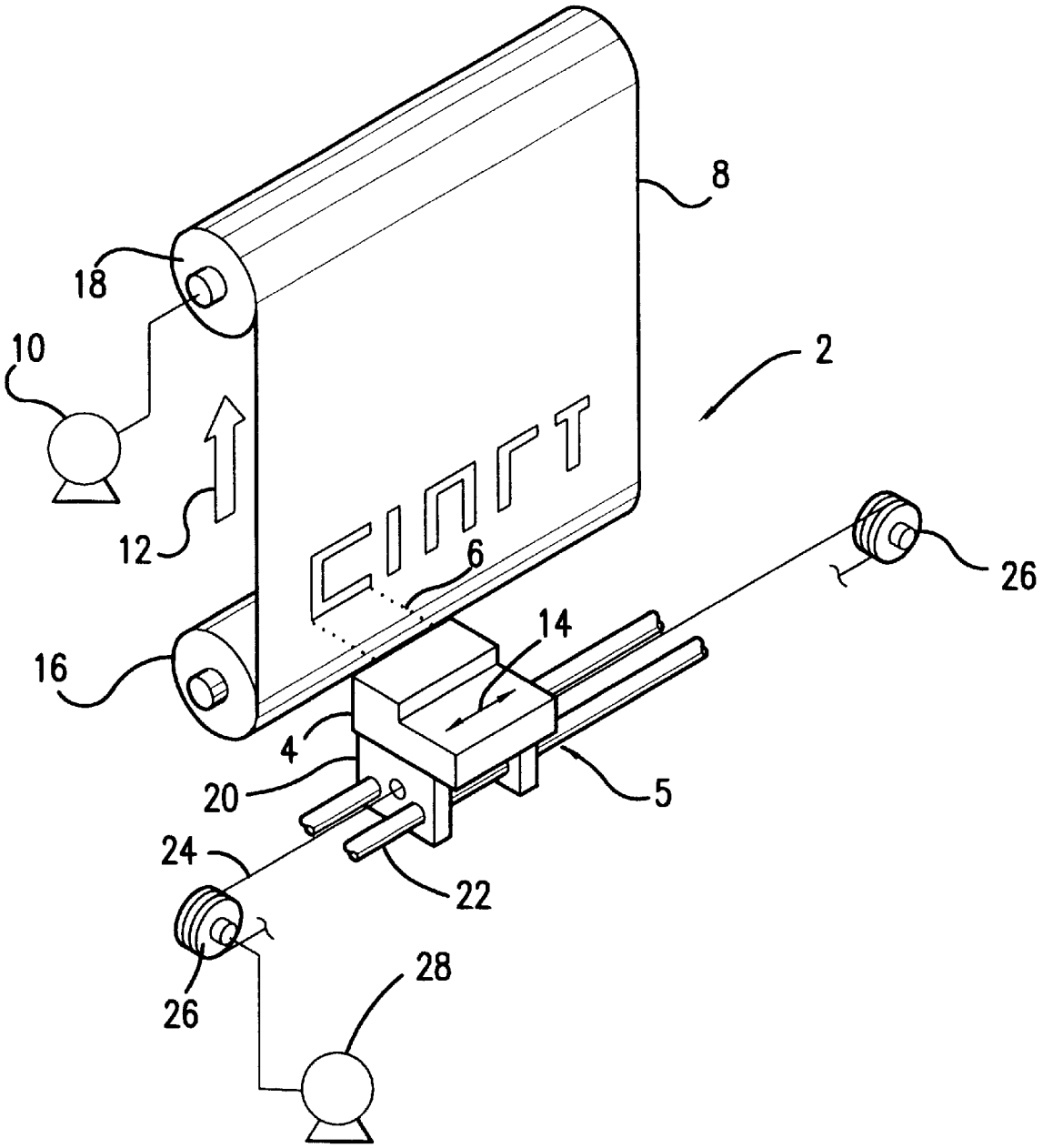
FIG. 1 is a schematic view of a prior art printing system.

FIG. 1 shows a typical carriage-type ink jet printing device 2. A linear array of droplet producing channels is housed in the printhead 4 of the reciprocal carriage assembly 5. Ink droplets 6 are propelled to a receiving medium 8 (such as a sheet of paper) that is stepped by a motor 10 a preselected distance in a direction of arrow 12 each time the printhead 4 traverses across the receiving medium 8 in the directions indicated by arrow 14. The receiving medium 8 can be stored on a supply roll 16 and stepped onto takeup roll 18 by stepper motor 10 or other means well known to those of skill in the art.

The printhead 4 is fixedly mounted on the support base 20, which is adapted for reciprocal movement using any well known means, such as two parallel guide rails 22. The reciprocal movement of the printhead 4 may be achieved by a cable 24 and a pair of pulleys 26, one of which is powered by a reversible motor 28. The printhead 4 is generally moved across the receiving medium 8 perpendicularly to the direction the receiving medium 8 is moved by the motor 10. Of course, other structures for reciprocating the carriage assembly 5 are possible.

Alternatively, the linear array of droplet producing channels may extend across the entire width of the receiving medium 8, as is well known to those of skill in the art. This is typically referred to as a full-width array. See, for example, U.S. Pat. No. 5,160,403 to Fisher et al. and U.S. Pat. No. 4,463,359 to Ayata et al., the disclosures of which are incorporated herein by reference.

Figure 2:
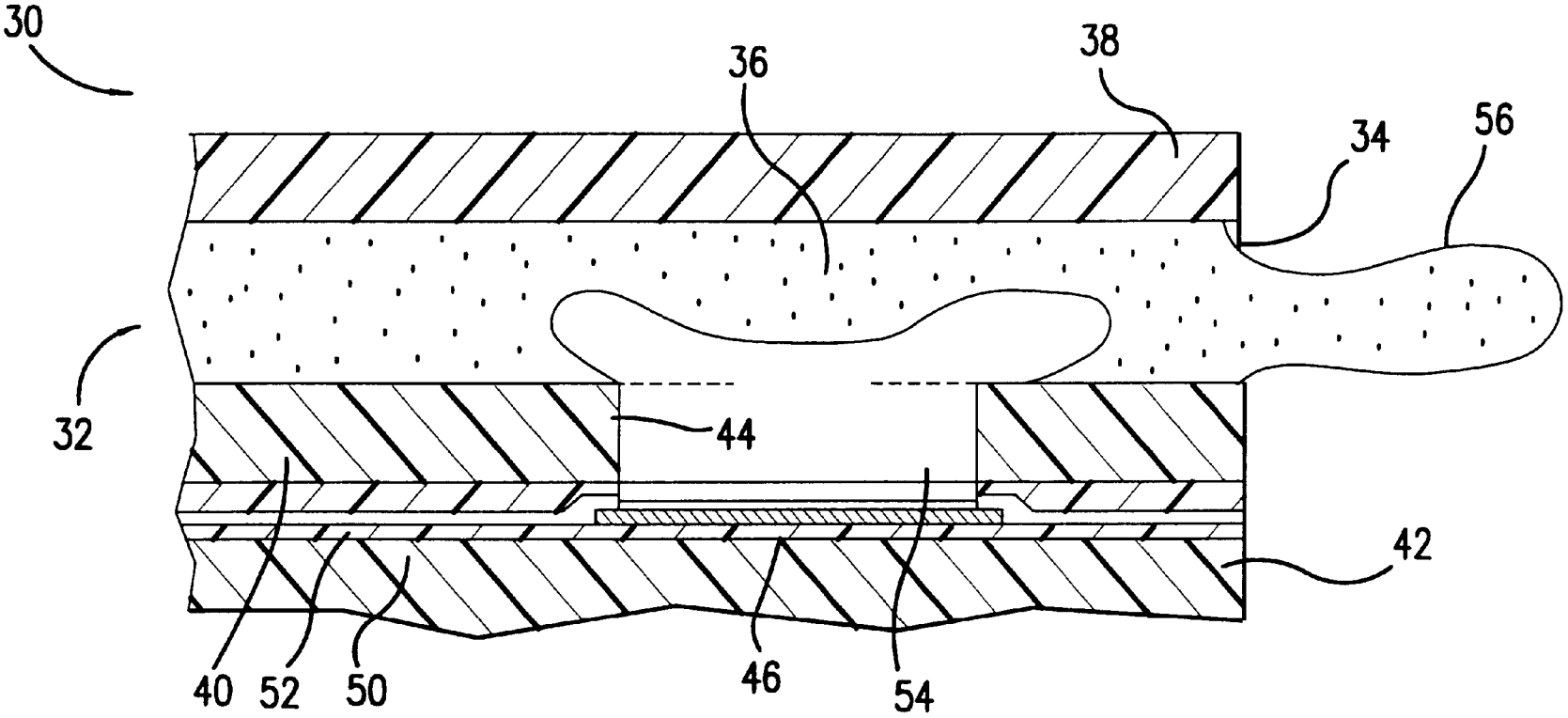
FIG. 2 is a cross-sectional view of a single ejector channel for a prior art ink jet printhead.

FIG. 2 shows an ink droplet emitter 30 (or ejector) of one embodiment of a typical ink jet printhead, one of a large plurality of such emitters found in an ink jet printhead. While FIG. 2 shows a side-shooter emitter, other emitters such as roof-shooter emitters may similarly be used with the present invention. Typically, such emitters are sized and arranged in linear arrays of 300 to 600 emitters per inch. A silicon member having a plurality of channels for ink droplet emission is known as a "die module" or "chip". Each die module typically comprises 128 emitters, spaced 300 or more to the inch. Generally, a carriage-type printhead will have a single die module. An ink jet printhead may have one or more die modules forming a full-width array extending the full width of the receiving medium on which the image is to be printed. In designs with multiple die modules, each die module may include its own ink supply manifold, or multiple die modules may share a common ink supply manifold.

Each emitter 30 includes a capillary channel 32 terminating in an orifice or nozzle 34. The channel 32 holds a quantity of ink 36 maintained within the capillary channel 32 until such time as a droplet of ink is to be emitted. Each capillary channel is connected to a supply of ink from an ink supply manifold (not shown). In the emitter 30 shown in FIG. 2, the main portion of channel 32 is defined by a groove etched into an upper substrate 38, which is typically made of crystalline silicon. The upper substrate 38 abuts a thick-film layer 40, which in turn abuts a lower substrate 42.

Sandwiched between the thick film layer 40 and the lower substrate 42 are electrical heating elements 46 for ejecting ink droplets from the capillary channel 32 in a well known manner. The heating element 46 is located within a recess 44 formed by an opening in a thick film layer 40. The heating element 46 is electrically connected to an addressing electrode 50. Each of the ejectors 30 in the printhead 4 has its own heating element 46 and individual addressing electrode 50. The addressing electrode 50 is protected by a passivation layer 52. Each addressing electrode 50 and heating element 46 is selectively controlled by control circuitry, as will be explained in detail below.

As is well known in the art, when a signal is applied to the addressing electrode 50, the heating element 46 is energized. If the signal is of a sufficient magnitude and/or duration, the heat from the resistive heating element 46 will cause the liquid ink immediately adjacent the heating element 46 to vaporize, creating a bubble 54 of vaporized ink. The force of the expanding bubble 54 ejects an ink droplet 56 (which may include a main droplet and smaller satellite drops) from the orifice 34 onto the surface of the receiving medium 8.

In conventional thermal ink jet printheads, a plurality of pulses may be applied to the heating element 46 for each ink droplet 56. Typically, one or more precursor pulses (warming pulses) are applied by the heating element 46 to warm the ink adjacent thereto. Subsequently, a print pulse (drive pulse) is applied to the heating element. The print pulse causes the droplet of ink to be ejected. The precursor pulses are typically used to raise the temperature of the ink adjacent the heating element and additionally may be used to control the volume of ink to be ejected in each droplet. The precursor pulses do not contain enough energy to cause a droplet to be emitted.

Figure 3:
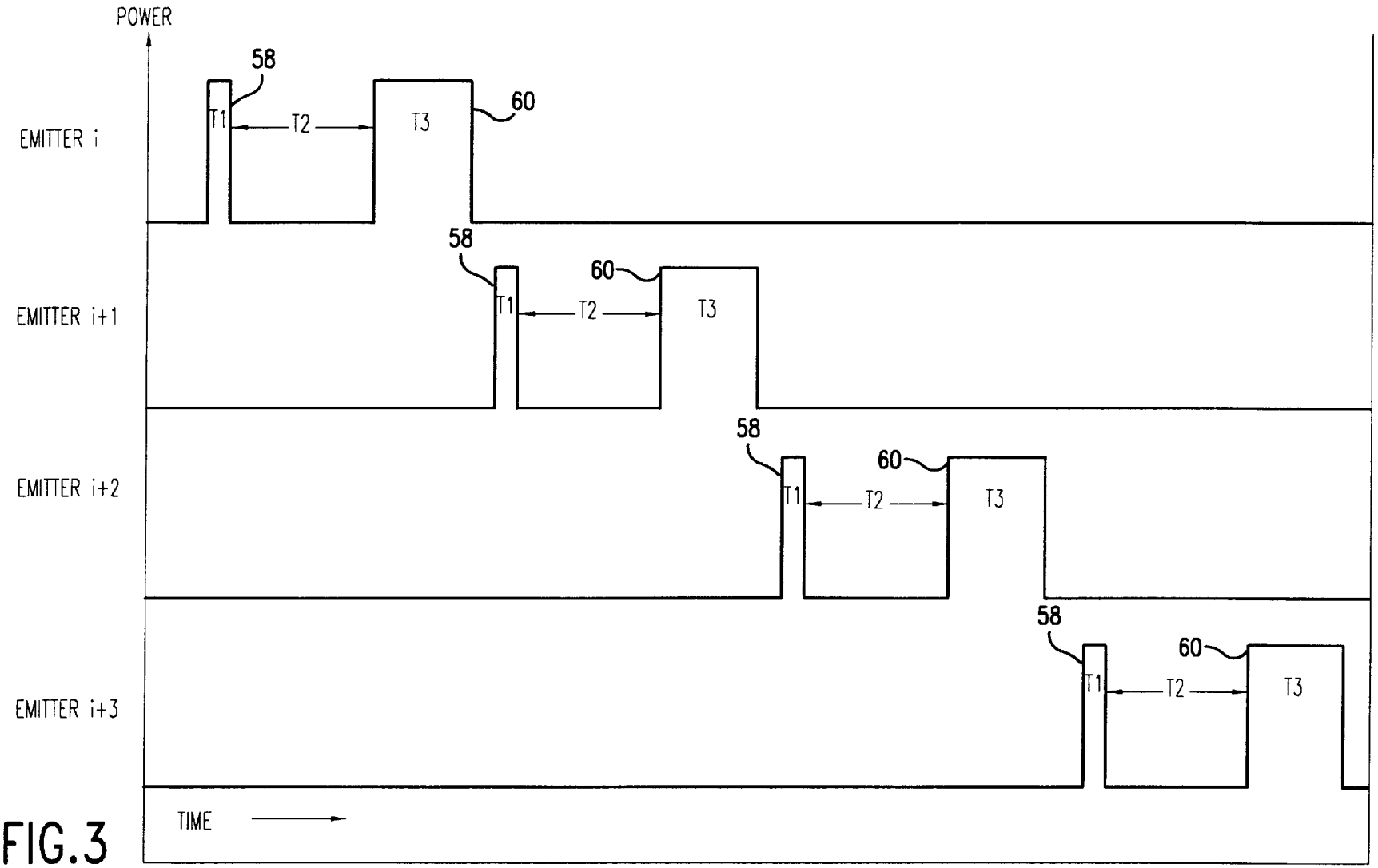
FIG. 3 PRIOR ART
FIG. 3 is a timing diagram showing how pulses are applied in the prior art printing device to banks of emitters.

FIG. 3 is a prior art timing diagram showing how a precursor pulse and a print pulse are applied to emitters (or emitter banks) according to a conventional thermal ink jet printhead. A precursor pulse 58, having a duration T1 is applied to an emitter i (or emitter bank i) to warm the ink and/or to control a size of the droplet to be ejected. This is followed by a relaxation time of duration T2. Then, print pulse 60 of duration T3 is applied to the emitter i. Subsequently, another precursor pulse 58 followed by a relaxation time and a print pulse 60 are applied to emitter i+1 (or emitter bank i+1). This process continues across a printhead in serial fashion until all the emitters (or emitter banks) required to eject drops of ink have been addressed.

Figure 4:
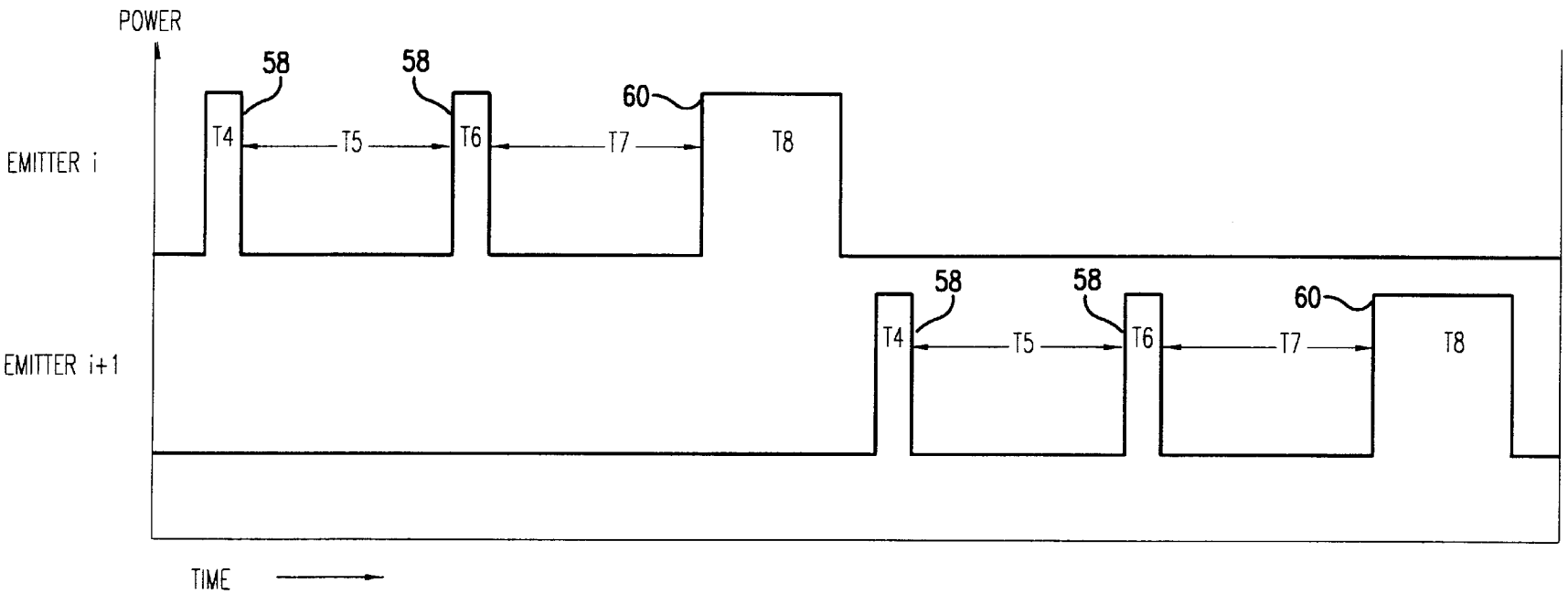
FIG. 4 PRIOR ART
FIG. 4 is a timing diagram showing how pulses are applied in a prior art printing device to banks of emitters.

FIG. 4 is a prior art timing diagram similar to FIG. 3 except that in FIG. 4 multiple precursor pulses 58 are applied to each emitter 30 prior to the print pulse 60. The multiple precursor pulses 58 are shown having durations T4 and T6, respectively and are separated from each other by a relaxation time of duration T5. The print pulse 60 is shown having a duration T8 and is separated from the second precursor pulse by a relaxation time of duration T7. The durations of all the pulses and relaxation times may vary as required. Similar to the timing diagram shown in FIG. 3, the pulses are applied sequentially to a single emitter 30 (or emitter bank) and then are subsequently sequentially applied to the other emitters 30 (or emitter banks) as required to eject the necessary droplets of ink.

Thus, conventional ink jet printheads that use multiple pulses to eject each drop of ink have a printing speed that is limited by the time required to sequentially apply the precursor pulses and print pulses as well as the relaxation times to individual emitters (or emitter banks) of the printhead.

The present invention interleaves in time pulses supplied to at least a first one of a plurality of emitters (or emitter banks) with a plurality of power pulses supplied to at least a second one of the emitters (or emitter banks). By interleaving in time the pulses supplied to the emitters, the printing speed of the thermal ink jet printhead according to the present invention is increased with respect to conventional thermal ink jet printheads, as will be further described below.

Figure 5:
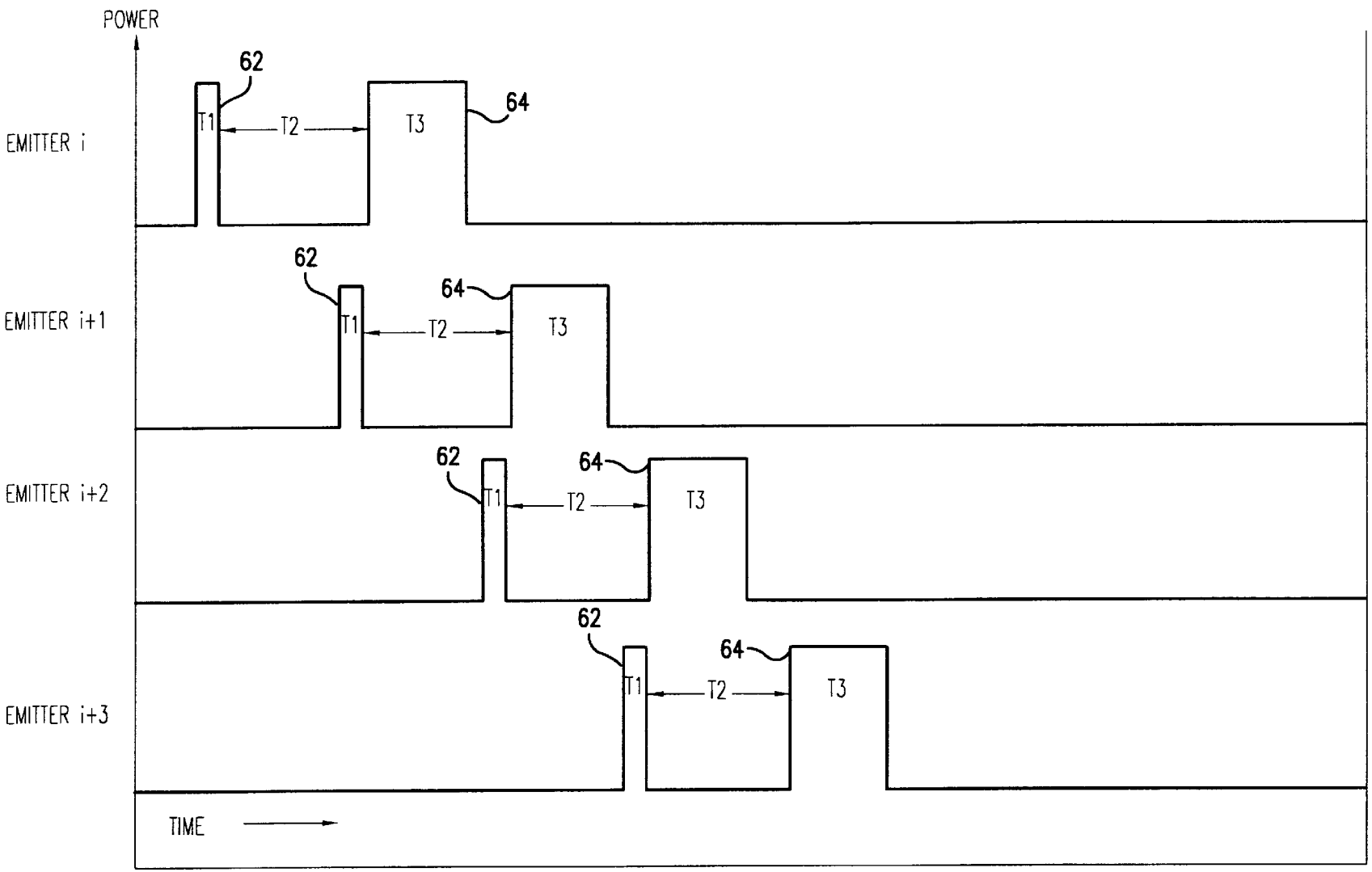
FIG. 5 is a timing diagram showing how pulses are interleaved in time according to a preferred embodiment of the present invention.

As shown in FIG. 5, a precursor pulse 62, having a duration T1, is supplied to a first emitter (or first emitter bank). Then, a relaxation time of duration T2 occurs when no pulses are supplied to the first emitter. Then, a print pulse 64 of duration T3 is applied to the first emitter (or first emitter bank), to cause a drop to be ejected. During the relaxation time of the first emitter, a precursor pulse 62 is applied to a second emitter (or second emitter bank). Similarly, the precursor pulse supplied to later emitters (or emitter banks) are interleaved in time between the precursor pulse and print pulse of previous emitters (or previous emitter banks). In this way, the total time necessary for printing across an entire printhead is reduced.

Figure 6:
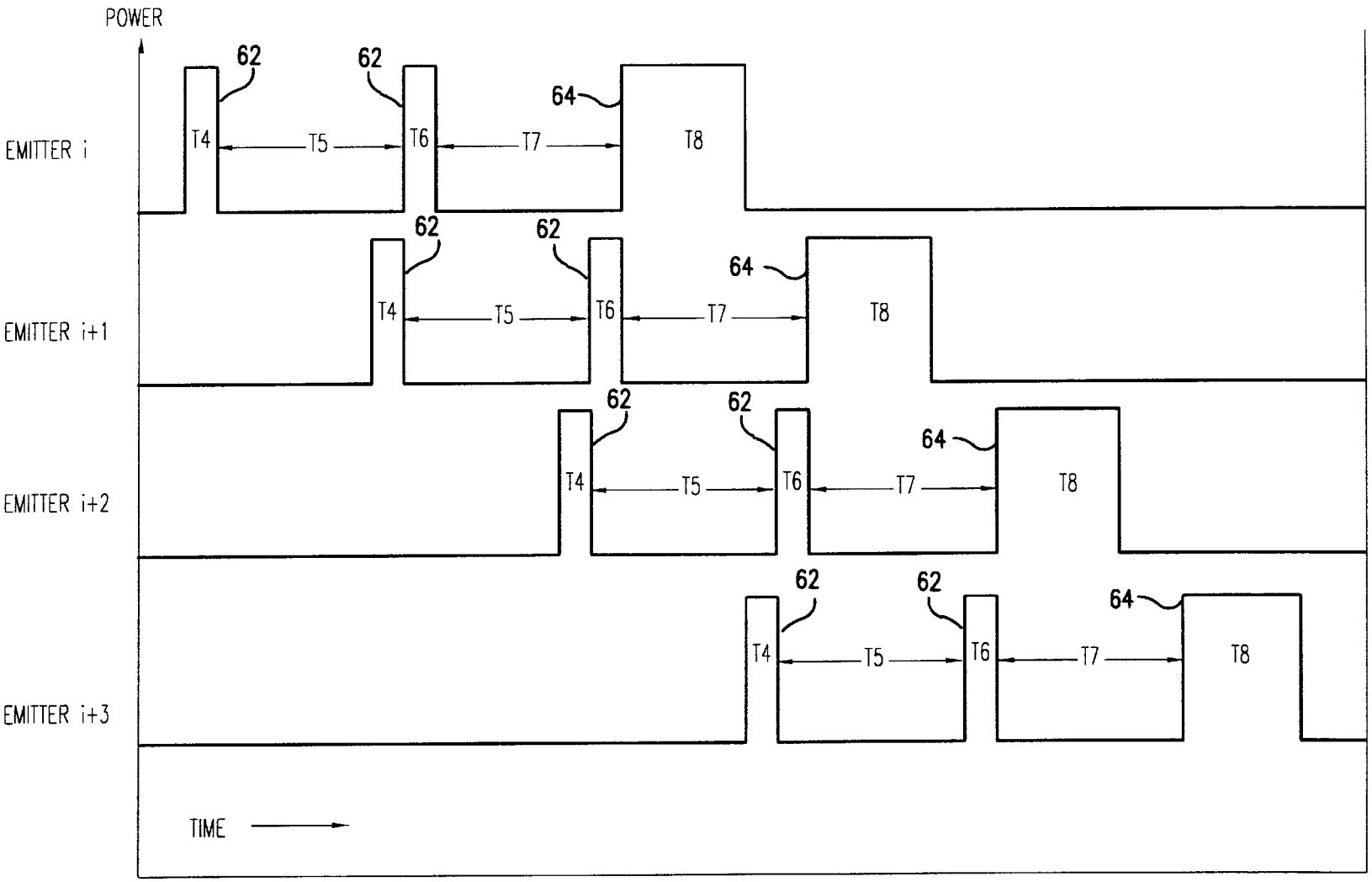
FIG. 6 is a timing diagram showing how pulses are interleaved in time according to a preferred embodiment of the present invention.

FIG. 6 is a timing diagram illustrating how pulses are interleaved in time according to a preferred embodiment of the present invention. FIG. 6 is similar to FIG. 5, except that in FIG. 6, two precursor pulses are applied to each of the emitters (or emitter banks). For any given emitter (or emitter bank), during the relaxation time between the precursor pulses and the print pulse, the precursor pulses of subsequent emitters (or emitter banks) are interleaved, Thus, a second precursor pulse of a second emitter and a first precursor pulse of a third emitter may be interleaved in time between a second precursor pulse and a print pulse of a first emitter. In a preferred embodiment, a second precursor pulse of a third emitter and a first precursor pulse of the fourth emitter are interleaved in time between a print pulse of a first emitter and a print pulse of a second emitter. Because the pulses are interleaved in time, there is never more than one pulse applied to any of the emitters at a given time.

Figure 7:
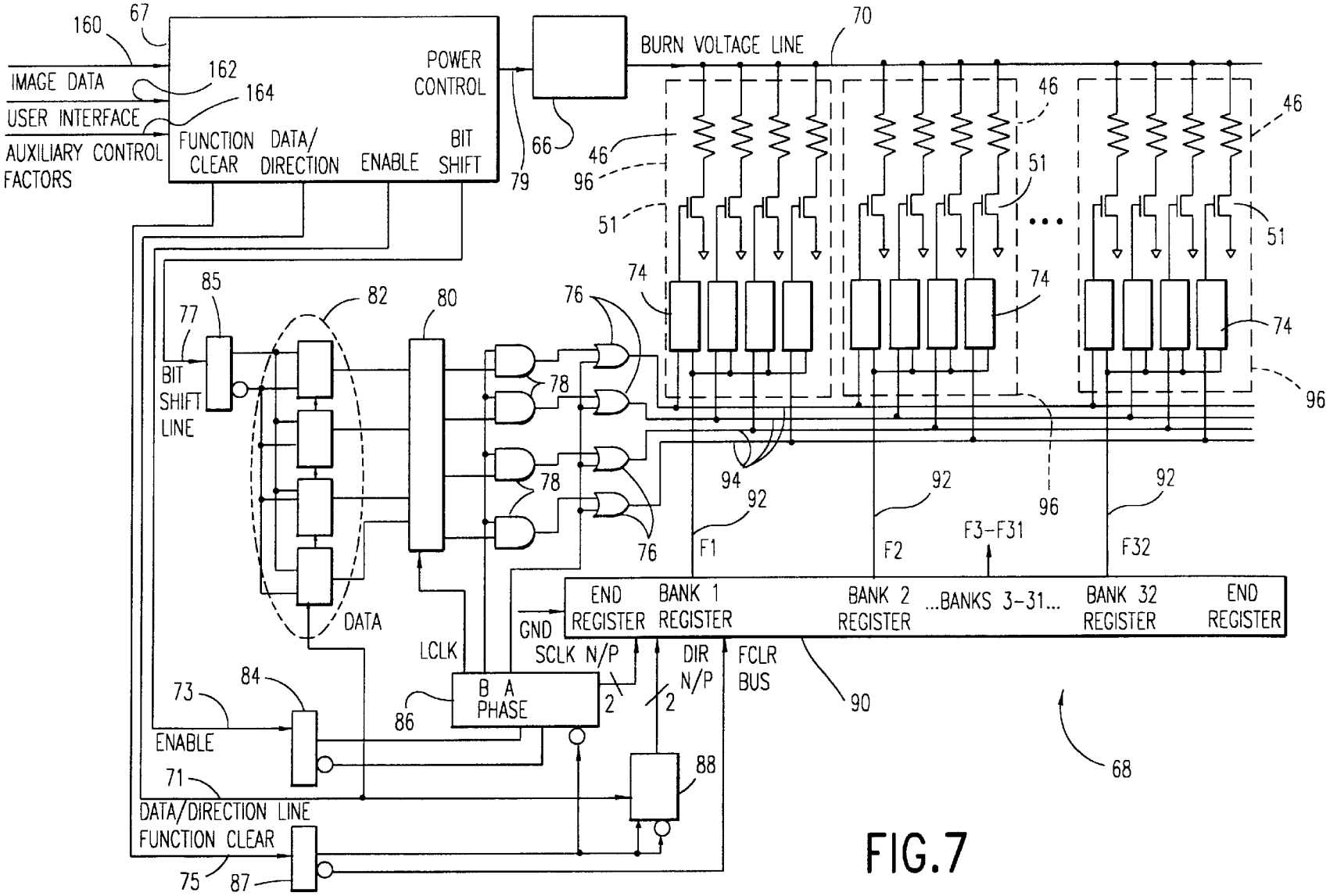
FIG. 7 is a systems diagram illustrating a thermal ink jet printhead, system controller and power source according to a preferred embodiment of the present invention.

FIG. 7 is a systems diagram illustrating an embodiment of the present invention having a thermal ink jet printhead 68, a power supply source 66 and a system controller 67. The thermal ink jet printhead 68 is activated by two pulses which are interleaved in time and supplied to different emitter banks 96. One of the pulses is controlled by the corresponding data which is to be recorded. In the embodiment shown in FIG. 7, there are 128 emitters, organized into 32 emitter banks 96 of four emitters per bank. The electrothermal transducers 46 which cause the ink emission are electrically attached to a power supply source 66 via the burn voltage line 70. Each electrothermal transducer 46 is also attached to a power transistor 51 which switches the burn voltage 70 to ground through the transducer 46.

The emitters are grouped into emitter banks 96 in order to achieve a good balance between the instantaneous power requirements, the number of external electrical leads which must be attached to the printhead, and the time required to provide power pulses to all of the emitters. The bank organization creates a set of emitters which can be pulsed individually without exceeding the capacity of the power supply source 66 and power carrying lead 70. At the same time, the bank organization allows the data to be presented to the printhead in units of the number of emitters in a bank 96, four in the embodiment of FIG. 7, saving interconnection leads. Also since the several emitters of a bank 96 are able to be pulsed simultaneously, the time required to cycle through all of the emitters of the printhead is reduced to the time needed to cycle through the banks 96. In the embodiment of FIG. 7 there are 32 banks 96 with four emitters each, 128 emitters in all. Thus, the banking organization allows the 128 emitters to be pulsed by a power source sized to supply only four emitters simultaneously, the data to be handled in units of four bits, and the full set of emitters to be addressed in 32 time subunits.

A predriver circuit 74 provides the necessary gate voltage level to the power transistor 51 so that it will turn fully on. The predriver circuit 74 functions like a logical AND gate having logical inputs from a data line 94 and the emitter bank selection shift register 90. The burn voltage and the gate voltage applied to power transistor 51 may be higher than a normal logic level of 3 to 5 volts. Typically the burn voltage is 35 volts to 45 volts and the gate voltage output of the predriver 74 is 7 volts to 14 volts. The predriver circuit 74 also serves as the interface between the low voltage logic circuitry and the higher voltage circuitry needed to apply power pulses to the electrothermal transducers 46. The remainder of the circuitry shown in FIG. 7 is operated at a typical logic level of 3 to 5 volts.

The data management and power pulse scheduling functions are accomplished by the other major circuit elements shown in FIG. 7. A system controller 67 accepts from an image source (not shown) on line 160, a system user interface (not shown) on line 162, such as a user panel or soft display interface, and one or more auxiliary control factor sources (not shown) on line 164, for example a temperature sensing and control system or an input media monitoring system as well as other signals for managing the total operation of the liquid recording apparatus (not shown). The overall system controller 67 provides the remaining circuitry with signals conveying data on line 71, direction of printing, also on line 71, data bit shift clocking on line 77, drop emission timing (ENABLE signals) on line 73, and logic circuit reset on line 75. The system controller 67 also manages the burn voltage power supply 66 on line 79. The data is entered via a DATA/DIRECTION LINE 71 in four bit serial fashion where it is latched by 4-bit serial data latch 82. At the proper time, controlled by the load clock, LCLK, the four bits of data are transferred and latched to the 4-bit parallel data latch 80. The LCLK signal as well as the other timing signals PHASE A, PHASE B, SCLK N, and SCLK P are generated by the timing generator circuit 86. The function of the timing generator circuit 86 is described in detail below. The data is further controlled by a set of four logical AND gates 78, which all have an additional logical input, the PHASE B signal. Therefore, only if the PHASE B signal is high will the four bits of data be presented to the inputs of four logical OR gates 76 and subsequently appear on the four data lines 94.

In the embodiment of FIG. 7 there is provided a signal PHASE A as an output from timing generator circuit 86, which can also be presented to all of the logical OR gates 76. This PHASE A signal is not controlled by the data, but, if presented to the logical OR gates 76, will be passed out to all of the data lines 94. Therefore, the predrivers 74 receive logical inputs from the data lines 94 for either the case of PHASE B AND DATA being high (logically true) or PHASE A being high (logically true). By controlling the timing relationships of PHASE A and PHASE B, the predrivers 74 can thus receive two power pulse commands, one which is the same for every emitter of the emitter bank 96 and derives from PHASE A, and a second which is controlled in time by PHASE B but is given only for emitters which also have DATA logic highs.

The phase A power pulses are precursor pulses that change the temperature of the ink near the heating element 46, thereby affecting the amount of ink emitted when an emitter receives a subsequent phase B AND DATA power pulse. The system controller 67 can modify the duration of the phase A power pulses via the enable signal. This may be accomplished by sensing the temperature of the ink near the emitter, or by sensing the temperature of the printhead near the emitter, with a temperature sensing element, such as in U.S. patent application Ser. No. 08/220,720 to Stephany, which has previously been incorporated herein by reference. There are many potential applications of the phase A precursor pulse. It can be used in conjunction with a temperature management system to adjust for different printhead and environmental temperature conditions so as to maintain constant ink emission. It can be used to selectively increase or decrease quantity of ink emission in response to a user's desire for darker or lighter images. It can be used to adjust for color balance in a recorder with multiple color printheads. It can be used to adjust ink emission for different ink formulations loaded into the printhead or for different print media such as overhead projection substrates or different paper types. These and many other possible uses of precursor pulses are determined by the overall printer system controller 67. Embodiments of the present invention enable such precursor pulses to be applied to emitters with improved time efficiency, resulting in faster recording speed than conventional devices.

Power pulsing of individual transducers 46 within an emitter bank 96 is controlled via an input to the predrivers 74 which are connected to the four data lines 94. A second input to the predrivers 74 is shared by all of the predrivers 74 of an emitter bank 96. There is provided a separate second predriver input line 92 for each of the 32 emitter banks 96 shown in the embodiment of FIG. 7. These second predriver input lines 92 are controlled by the bank selection shift register 90. The bank selection shift register 90 has 32 outputs, F1–F32, one for each emitter bank 96. When one of the output lines F1–F32 is logically high, the corresponding emitter bank 96 is able to be pulsed since the predrivers 74 of the corresponding bank are now able to close the corresponding power transistor switches 51 in response to signals from the data lines 94. The bank selection shift register 90 functions to allow only one emitter bank 96 to be pulsed during any instant of time since the power source has been sized to accommodate only one emitter bank 96 at a time, to synchronize the selection of an emitter bank 96 with the proper set of 4 bits of data appearing on the data lines 94 for that bank 96, and to cycle through all of the emitter banks 96 so that there is an opportunity for every emitter to be activated by both PHASE B pulses and PHASE A pulses. The bank selection shift register 90 further provides for the interleaving of the pulses between the emitter banks 96, as illustrated in FIG. 5, so that full cycling through all of the banks 96 for the two pulses can be accomplished much more rapidly than if the pulses were not interleaved, as in the prior art illustrated in FIG. 3. The bank selection shift register 90 is also bi-directional so that the selection of emitter banks 96 can proceed from the first bank to the last bank or vice versa. This is useful for printing as illustrated in FIG. 1, whereby the printhead 4 is allowed to print when traversing in both right to left and left to right directions of the carriage 20. Further details about the design of the bank selection shift register 90 are given below in the discussion of FIGS. 9, 10 and 11.

The timing generator circuit 86 provides the signals: LCLK, PHASE A, PHASE B, SCLK N, and SCLK P. The LCLK causes the 4-bit parallel shift register 80 to latch whatever data is held by the 4-bit serial shift register 82. The PHASE A signal allows all of the emitters of an emitter bank 96 to receive power if the bank's bank selection line (F1–F32) is currently held high by the bank selection shift register 90. The PHASE B signal allows each of the emitters of a bank of emitters 96 to receive power if the data line 94 for the emitter is high and the bank's bank selection line (F1–F32) is being held high by the bank selection shift register 90. Shift clock signals SCLK N and SCLK P are non-overlapping logical inverses of each other and cause the bank selection shift register to advance a token bit thereby shifting the selected bank of emitters 96 along the 32-bank row. The bank selection shift register 90 operates bi-directionally so that the banks of emitters 96 can be selected in opposite order for printing in bi-directional carriage printer fashion, as illustrated in FIG. 1.

The timing generator circuit 86 derives its output signals from the logic input on the ENABLE LINE 73 and the non-overlapping logical inverse of the signal input on ENABLE LINE 73, both are provided by the non-overlapping signal generator 84, and from the signal input on the FUNCTION CLEAR LINE 75, which serves to logically reinitialize the timing generator circuit 86 at the beginning of each printing cycle. Both the ENABLE and the FUNCTION CLEAR signals are provided by an overall printer system controller 67. The timing generator 86 is a signal passing circuit which constructs the output signals from specific logic level transitions present in the ENABLE input signal. The function of the timing generator circuit can be further understood by reference to FIG. 8, a timing diagram of the signals which have been described above.

Figure 8:
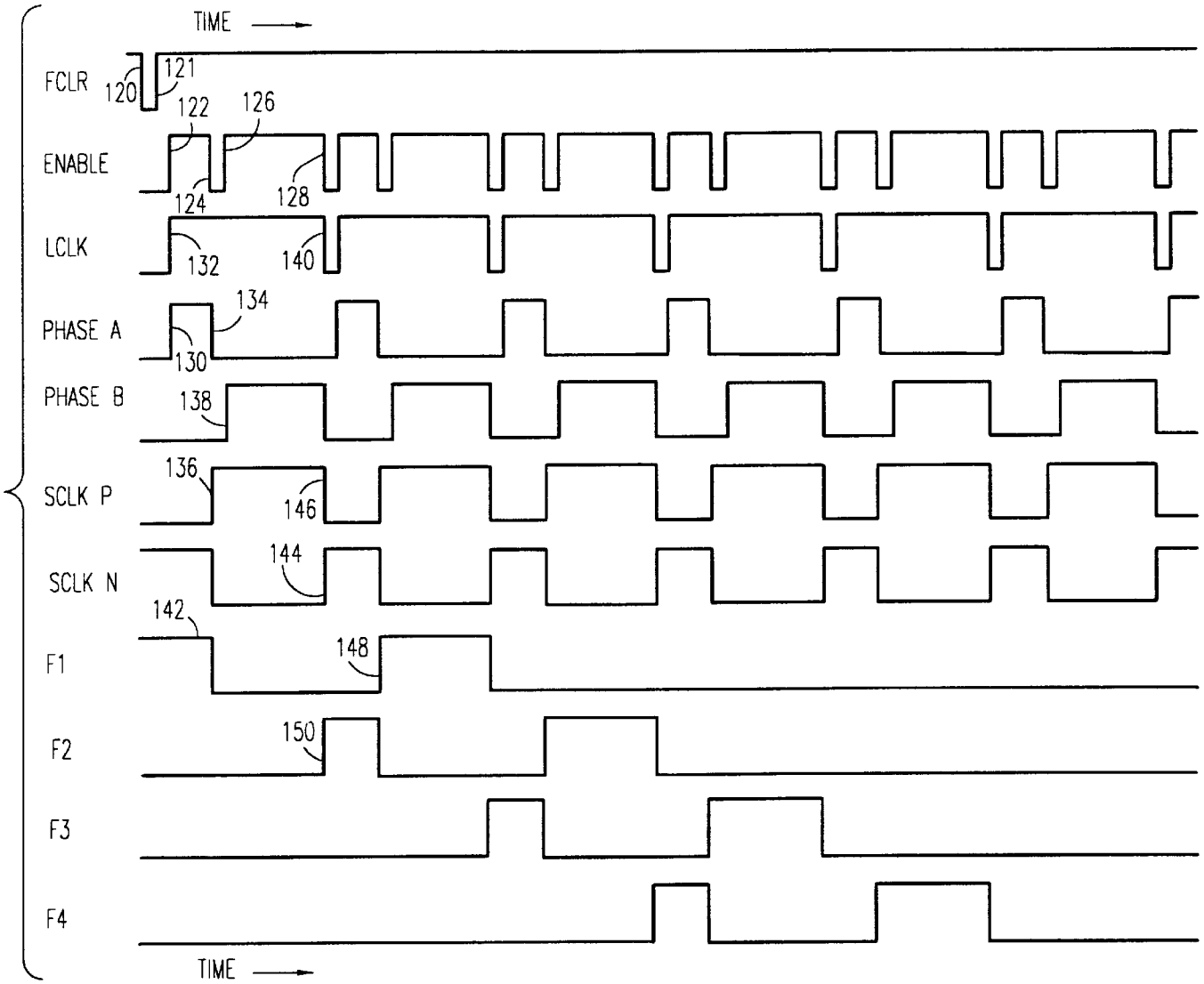
FIG. 8 is a timing diagram illustrating the timing of the thermal ink jet printhead of FIG. 7.

FIG. 8 shows the timing relationships among the following signals: FUNCTION CLEAR (FCLR), ENABLE, PHASE A, PHASE B, F1, F2, F3, F4, SHIFT CLOCK (SCLK N and SCLK P), and LOAD CLOCK (LCLK). FIG. 8 illustrates the timing relationships for the case of sequentially selecting emitter banks 96 from BANK 1 to BANK 32. Bank selection signals are shown for BANKS 1–4 only. Signals for BANKS 5–32 would be generated in a continuing sequence in like manner to the signals F1–F4 before a new FCLR logic transition was sent by the printer system controller. The falling logic level edge 120 of the FCLR signal initializes the circuitry shown in FIG. 7. It causes all of the other signals shown in FIG. 8 to be in the low state except F1 and SCLK N, which are initialized high for this case of sequencing emitter banks 96 in the order BANK 1 to BANK 32. For the opposite direction of sequencing, F32 and SCLK N are initialized as high when the falling FCLR edge 120 occurs.

The ENABLE signal has a repeating sequence of four logic transition edges: 122, 124, 126, and 128. ENABLE logic rising edge 122 is passed by the timing generator circuit 86 to its PHASE A output causing the Phase A rising logic edge 130 and to its LCLK output causing the LCLK rising logic edge 132. The rising edge 132 of LCLK latches whatever DATA is appearing at the output of serial data latch 82 into parallel data latch 80. In FIG. 8 the first instance of the rising edge of PHASE A 130 results in power being applied to all of the jet transducers 46 of jet BANK 1 since F1 is also logically high.

The first logic falling edge 124 of the ENABLE signal is passed by the timing generator 86 to its PHASE A output. The PHASE A signal is thereby sent low as indicated by the PHASE A falling edge 134. This ends the PHASE A power pulse to the selected emitter bank 96, BANK 1 for the case illustrated by FIG. 8. The logical inverse of this first logic falling edge 124 of ENABLE is also available from the non-overlapping signal generator 84 and is passed by the timing generator circuit 86 to its SCLK P output where it causes the SCLK P rising logic edge 136. The SCLK P rising logic edge 136 is important to the interleaving function of the FIG. 7 circuitry of this preferred embodiment of the invention. The first logic falling edge 124 of ENABLE, translated into the rising edge 136 of SCLK P by the timing generator 86, is used to insure that power pulses related to the PHASE A signal and applied to one of the emitter banks 96 are terminated before power pulses related to the PHASE B signal are applied to the next emitter bank 96. The logical inverse shift clock, SCLK N, is also provided by the timing generator 86 and is also used internally in the bank selection shift register 90 to advance a logical high bit along the cells of the shift register. The bank selection signals F1–F4 will be further explained below in conjunction with the more detailed explanation of the bank selection shift register 90 using the additional FIGS. 9–11.

The second logic rising edge 126 of the ENABLE signal is passed by the timing generator circuit 86 to its PHASE B output, causing the rising logic edge 138 in the PHASE B signal. As described above, the PHASE B signal is logically ANDED with the DATA present in the parallel data latch 80 and therefore determines when DATA will be presented to the OR gates 76 for presentation to the data lines 94.

The second logic falling edge 128 of the ENABLE signal is passed by the timing generator 86 to its PHASE B output, shutting off the presentation of DATA to the OR gates 76, to its SCLK P output and to its LCLK output. In the case of the LCLK output, the logic falling edge 140 allows new DATA to be presented to the parallel data latch 80. The use via the SCLK P output of the second logic falling edge 128 of the ENABLE signal in the bank selection shift register 90 will be explained in more detail below in conjunction with the explanation of FIGS. 9–11.

The ENABLE signal continues to repeat the same sequence of rising and failing logic transitions 122–128 causing the events of data latching, PHASE A power pulse firing, PHASE B AND DATA power pulse firing, and sequencing through the banks of emitters 96 until all 32 banks of emitters have been selected for one PHASE A and one PHASE B time period. The bank selection shift register 90 described below further functions to interleave the two pulses to a bank of emitters with the pulses to the adjacent banks of emitters, thereby allowing the pulsing of all of the 128 emitters to proceed in a rapid, time efficient fashion.

Three other circuits are illustrated in FIG. 7 which are used in this preferred embodiment of the invention. The non-overlapping signal generator 85 controls the operation of the 4-bit serial data latch 82. A BIT SHIFT signal via line 77 is provided by the overall printer system which is passed by the non-overlapping signal generator 85 to the 4-bit serial data latch 82 in non-overlapping original and logically inverted forms. The overall printer system can then present DATA to the DATA/DIRECTION line 71 and clock this DATA into the 4-bit serial data latch 82 at a clock rate determined by the BIT SHIFT line 77. This can be done any time when the LCLK signal output of the timing generator circuit 86 is high without affecting the rest of the data path circuitry elements 80, 78 and 76.

In FIG. 7, a direction signal generator 88 is shown which provides to the bank selection shift register 90 the signals DIR N and DIR P. The direction signal generator 88 derives from the DATA/DIRECTION line 71 and FUNCTION CLEAR line 75 signals provided by the overall printer system controller 67. This signal establishes whether the bank selection shift register 90 will advance from emitter BANK 1 to emitter BANK 32 (DIR N, high; DIR P, low) or in the opposite direction from emitter BANK 32 to emitter BANK 1 (DIR N, low; DIR P, high). The DIR N/P state is set by the logical state of the DATA/DIRECTION line 71 at the time the FCLR makes its rising logic transition 121 shown on the timing diagram of FIG. 8. Until the next FCLR signal is sent by the printer system controller 67, the DATA/DIRECTION line 71 is used to shift in DATA as described above and the direction signal generator ignores the data signals on this shared line. The printer system controller 67 provides the proper direction signal at each FCLR rising logic transition 121.

In FIG. 7 a non-overlapping signal generator 87 accepts the FUNCTION CLEAR signal from the printer system controller 67 and generates non-overlapping logical inverses of FUNCTION CLEAR (FCLR and FCLR BUS). FCLR BUS, the inverse of FCLR, is used internally by the bank selection shift register 90 to initialize internal states of the cells of the shift register 90. This will be explained further below.

Figure 9:
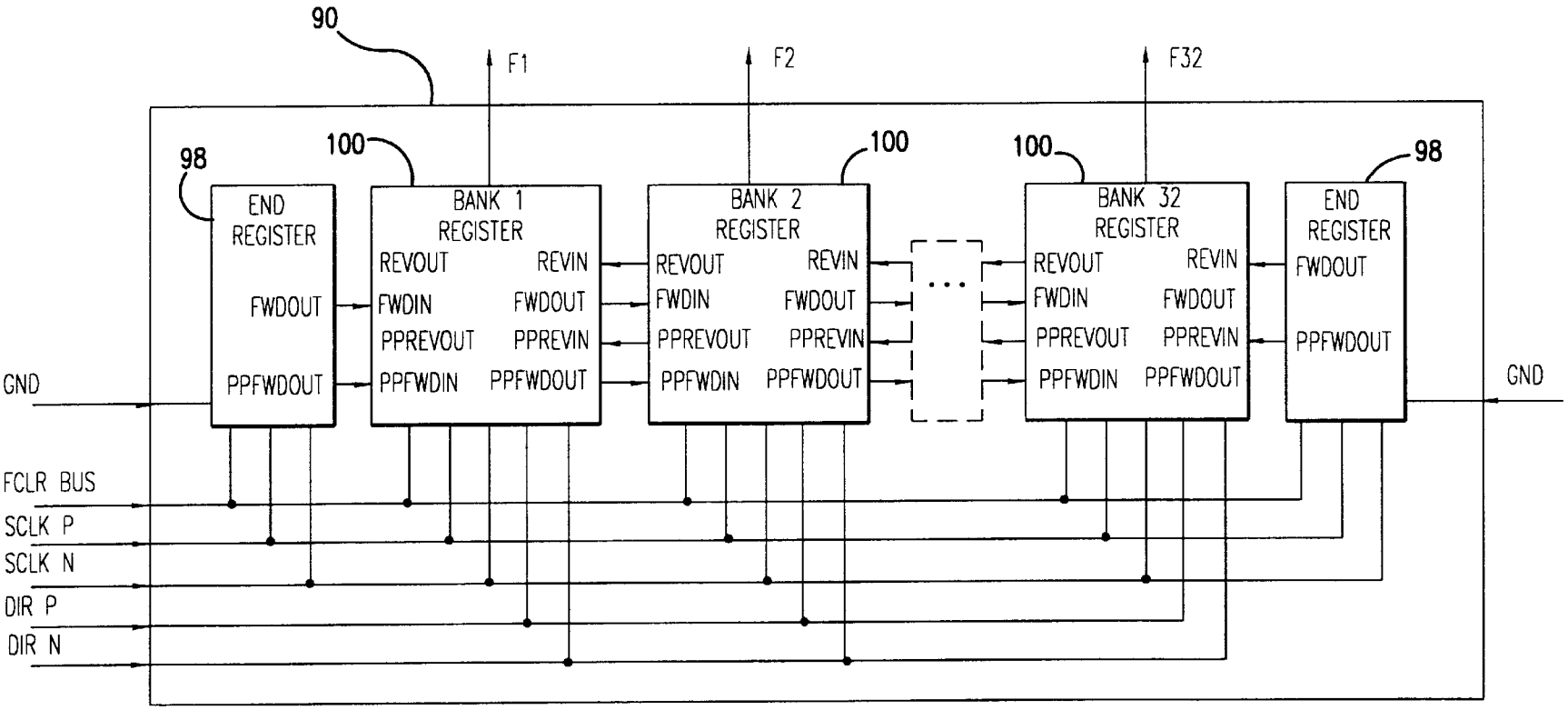
FIG. 9 is a schematic diagram illustrating the shift register of FIG. 7.
Figure 10:
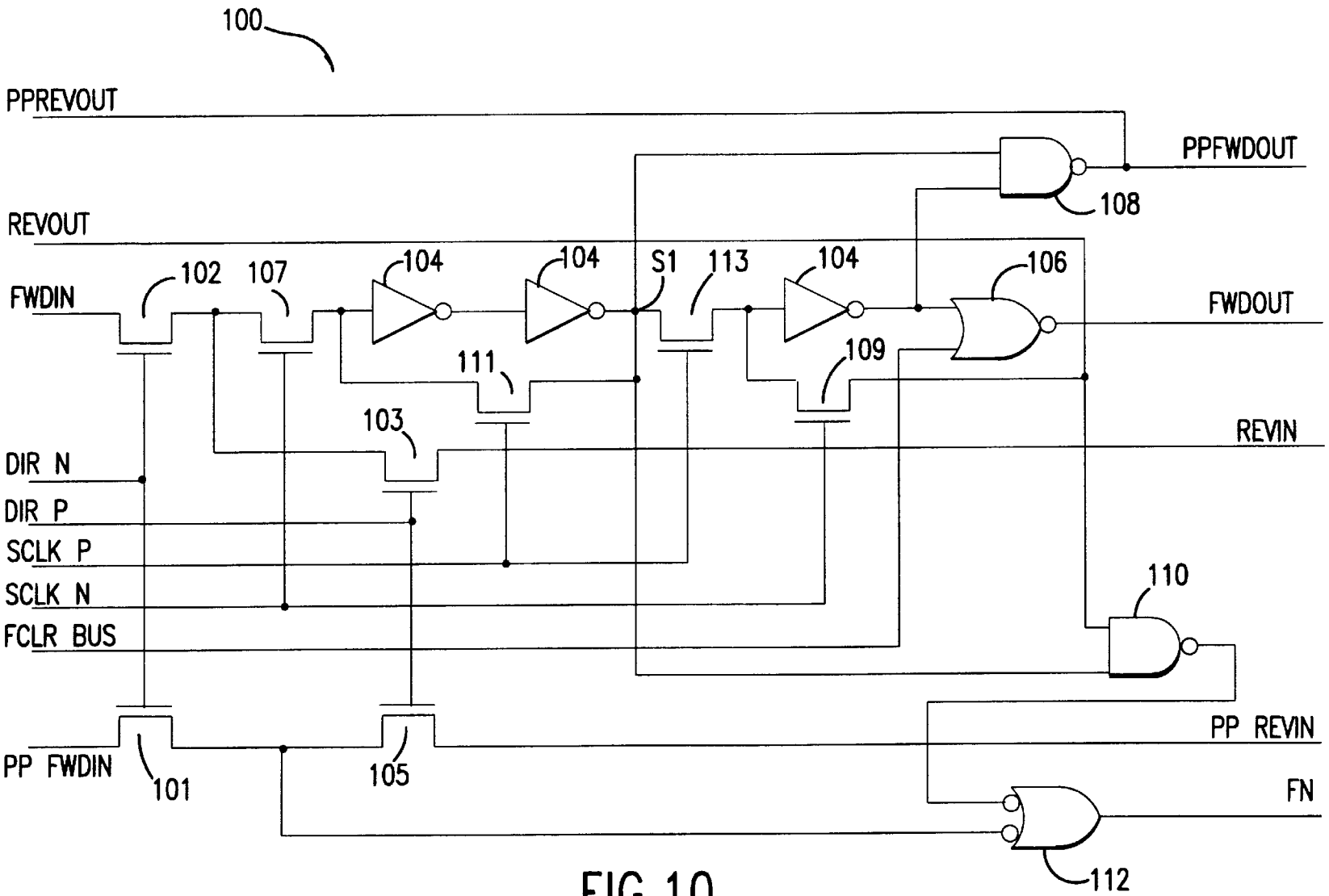
FIG. 10 is a schematic diagram of one of the main cells of the shift register of FIG. 9.
Figure 11:
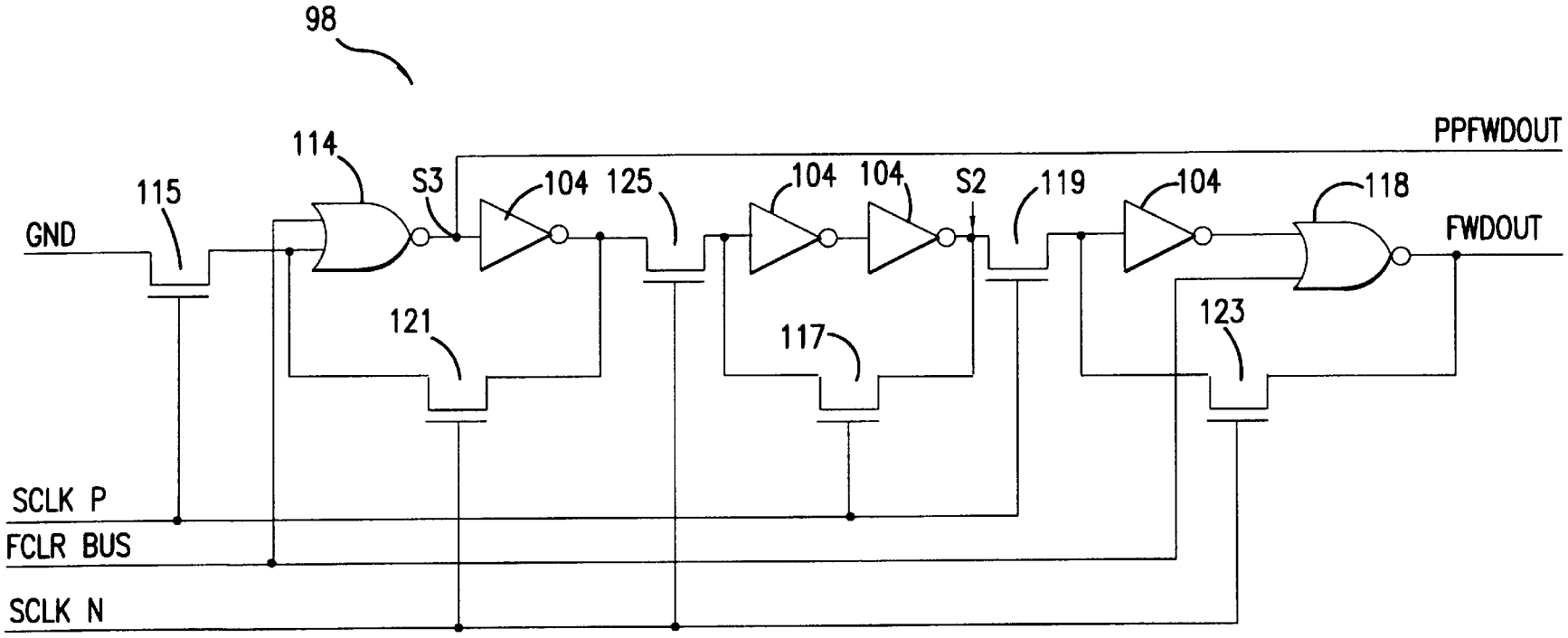
FIG. 11 is a schematic diagram of one of the end cells of the shift register of FIG. 9.

Further details of the bank selection shift register 90 are shown in FIGS. 9–11. Such registers are well known in the art. In the simplest form they consist of internal logic cells which can pass and hold a logic state from one cell to the next. Shift registers which are used to transfer logic control along a succession of outputs are also well known as token bit shift registers. The cells of the shift register are all set to logic level 0 (low) and then a single logical value of 1 (high), called the token, is shifted from cell to cell causing the outputs of the cells of the shift register to output the logical 1 (high) moving with each shifting clock event from output to output along the shift register. The bank selection shift register 90 is a simple token bit shift register with two additional functions. First, it can operate bidirectionally so it has circuitry in each cell which can pass the token bit either to the cell numerically above or numerically below itself. And second, to perform the interleaving function of the invention, the bank selection shift register 90 also passes the token bit forward one cell for part of the ENABLE signal as generated by the timing generator 86 outputs SCLK N and SCLK P.

FIG. 9 shows the internal organization of the bank selection shift register 90 of FIG. 7 in more detail. There are 32 identical emitter bank cells 100 of the bank shift selection register 90, one for each of the emitter banks 96, and two end cells 98 to properly initialize the action of the bank selection shift register 90 in whichever direction it is being operated. Each of the bank cells 100 has four inputs and four outputs which link adjacent cells to one another and are internal to the bank selection shift register 90. Each of the bank cells 100 also has five signal inputs which come from the printer system controller 67 via the FCLR generator 87 (FCLR BUS), via the direction signal generator 88 in FIG. 7 (DIR N, DIR P) and via the timing generator 86 in FIG. 7 (SCLK N, SCLK P). Finally, the bank cells 100 each have an output line FN (F1–F32), which is directly connected to the predrivers 74 of the corresponding emitter banks 96. As described earlier, when a logic high level appears on one of the bank cell output lines F1–F32, the predrivers 74 of the corresponding emitter bank 96 then close the power transistor switches 51 of that emitter bank 96 if either PHASE A or DATA AND PHASE B high signals are presented by OR gates 76 to the data lines 94.

The four internal input and four output lines shown for each of the cells 100 of FIG. 9 arise because, firstly, for simplicity of design and understanding when constructing shift registers of many cells, it is helpful to designate lines which pass signals from one cell to the next as having both an output end and an input end even though once actually assembled they will be the same wire or conductor run inside the circuit. Secondly, since the bank selection shift register 90 is bidirectional, there are two sets of inputs and outputs, one for the "forward" direction (DIR N, high; DIR P, low) and one for the "reverse" direction (DIR N, low; DIR P, high). Finally, because of the need to interleave the power pulses going to one emitter bank 96 with those going to an adjacent emitter bank 96, both a main control token signal and an advanced or prepulsing token signal are needed. Thus the eight internal input and output signal lines shown in FIG. 9 for each bank cell 100 are labeled in the following fashion. The suffix IN or OUT indicates whether the signal is being used as an input (IN) to the particular bank cell 100 or passed out (OUT) of the particular bank cell 100. The three letter root (FWD) or (REV) designates whether that line is active for the forward (FWD) direction of shift register operation (DIR N, high; DIR P, low) or for the reverse (REV) direction of shift register operation (DIR N, low; DIR P, high). Finally the outputs and inputs with the additional prefix (PP) are the lines which carry the advanced token (prepulse token) ahead of the main token lines (without prefix). It is these PP signal lines (PPFWDIN, PPFWDOUT, PPREVIN, PPREVOUT) which will allow a bank of emitters 96 to receive power during the PHASE A signal, earlier in time then that emitter bank 96 receives its power based on the PHASE B AND DATA signal. The main token signal lines (FWDIN, FWDOUT, REVIN, REVOUT) control the bank selection for receiving power during the PHASE B AND DATA signal period which results in emitters actually emitting print drops of ink. The power received by an emitter bank 96 during the PHASE A period is generally intended to precondition the ink temperature thereby affecting the volume and velocity of the ink which will be emitted for emitters subsequently receiving power during the bank's PHASE B period.

The two end cells 98 shown in FIG. 9 supply the initial tokens for both the main token and the prepulse token inputs to either the BANK 1 cell 100 or to BANK 32 cell 100 depending on the direction of operation being determined by the DIR N and DIR P signal lines. For the example shown in the timing diagram of FIG. 8, the DIR N/P lines are set to operate the bank selection shift register 90 from BANK 1 to BANK 32. In this case end register 98 connected to the BANK 1 cell 100 is active. In response to the rising logic high edge of the FCLR BUS (the inverse of the falling logic edge 120 shown for the FCLR signal in FIG. 8) the end register 98 will provide a pretoken signal on its PPFWDOUT line to the PPFWDIN line of the BANK 1 shift register cell 100. This PPFWDOUT signal is passed by the BANK 1 cell 100 to its output Fl as a logic high, shown in the timing diagram FIG. 8 as high level 142 on the F1 line. The end cell 98 will also provide on its signal line FWDOUT the first main token to the BANK 1 cell 100 on its input line FWDIN. The end cell 98 derives this initial main token from the FCLR BUS signal. The initial token is latched by the rising logic edge of SCLK P which in turn has been generated by the timing generator circuit 86 from the first falling logic low edge 124 of the ENABLE signal.

Further detail on the circuit design and operation of the bank cell 100 and the end cell 98 can be understood from FIGS. 10 and 11. In FIG. 10, the circuit diagram of a bank cell 100 illustrates the eight internal signal lines, the five external signal inputs and the one external output, FN (F1–F32) together with the pass transistors 101, 102, 103, 105, 107, 109, 111 and 113, inverters 104, and logic function circuits 106, 108, 110 and 112 needed create the signals described above. For simplicity of understanding, the direction of operation of the shift register can be ignored by considering the operation for one direction since the operation in the opposite direction is the same except that the physical location of the input and output lines changes. Only one set of lines, either FWD lines or REV lines is physically active at any time. For the timing diagram example illustrated in FIG. 8, the forward direction has been selected and so the FWD lines of the cell 100 in FIG. 10 are being used. The two signal pass transistors 101 and 102 controlled by DIR N are therefore on, allowing signal to pass into the cell from the FWDIN and PPFWDIN lines. The two signal pass transistors 103 and 105 controlled by DIR P are off, stopping signals from passing into the cell from the REVIN and PPREVIN lines.

At the lower portion of the bank cell 100 circuit it can be seen that a signal appearing on the PPFWDIN line is passed by transistor 101 to NAND gate 112 whose output is the bank selection signal, FN. FN is connected to the corresponding set of predrivers 74 for the corresponding emitter bank 96. Therefore the preceding cell can affect the FN signal of a current cell by holding a low signal on PPFWDIN, that is on its own PPFWDOUT line.

The SCLK N and SCLK P lines each control two signal pass transistors 107, 109, 111 and 113 respectively. The two signal pass transistors 107 and 109 controlled by SCLK N control the entry of signals from FWDIN into the cell 100 at circuit point S1 in FIG. 10. The main token is sampled and latched when SCLK N has rising logic edges such as SCLK N edge 144 in FIG. 8. The two signal pass transistors 111 and 113 controlled by SCLK P control the presentation of output signals to FWDOUT in FIG. 10. Signals appearing at FWDOUT are presented to the next shift register cell 100 via its FWDIN line. FWDOUT signals are also presented to the FN line via NAND gate 110 and NAND gate 112. Therefore high signals at FWDOUT both allow power pulsing of the corresponding bank of emitters 96 and provide a high token signal for the next cell on the next cell's FWDIN line.

In addition when the FWDIN line is sampled at circuit point Si (by SCLK N rising and SCLK P falling) and if it is a logic level 1, the main token is present. Then, PPFWD-OUT is asserted low by NAND gate 108 until the SCLK's change state again. This is the prepulse token passing event described above. It occurs when a cell has received a logical high signal, the main bank selection token, via its FWDIN line which is latched at circuit point S1. When SCLK N falls low again, and SCLK P goes high, the main token signal high is presented to both FWDOUT for latching by the next cell and to FN to allow pulsing of the corresponding bank of emitters 96 during PHASE B as described above.

Thus the action of the cell 100 when operating in the forward direction is to accept a high signal on its FWDIN line if one is present from the previous cell's FWDOUT line during one logical high period of SCLK N and then to provide a high signal to the cell's FN line and FWDOUT line during the next logical low period of SCLK N. During the high period of SCLK N (and so the low period of SCLK P), the cell passes a logic low level to the next cell's PPFWDIN line resulting in an F(N+1) high at the output of that next cells NAND gate 112.

The cell output line FWDOUT is held logically low by NOR gate 106 which has the FCLR BUS signal line as one of its inputs. Only the passage of the main token high signal through latch point S1 overrides this low being set by FCLR BUS and NOR gate 106.

Finally, the above explanation of the operation of the main cell 100 of the bank selection shift register 90 applies equally to the case of the reverse direction of the operation (DIR N, low; DIR P, high) except that the REV signal lines are substituted for the corresponding FWD signal lines. The circuitry controlled by SCLK N, SCLK P and FCLR BUS operates in the identical fashion in the reverse direction.

The above explanation of the main cell 100 operation is largely applicable to the end cell 98 diagrammed in FIG. 11. An end cell 98 is necessary to begin the process described above of main token acceptance, passing the token forward to allow prepulsing, and passing the main token. The end cell 98 shown in FIG. 11 is similar to the main cell 100 in that its circuit signal point S2 is equivalent in design and behavior to the circuit points S1 discussed above in conjunction with the main bank cell 100 circuit. The end cell 98 has an additional earlier stage which features NOR gate 114 with inputs from FCLR BUS and from ground (GND, logic low or 0) controlled by a SCLK P signal pass transistor 115. This first stage of the circuit generates and latches at circuit point S3 a logic low during the FCLR BUS high signal. This logic low at 53 persists during the initial SCLK P low time period (see the timing diagram in FIG. 8) and is passed forward on the PPFWDOUT line to the BANK 1 cell 100. This allows the first bank of emitters 96 to receive power pulses during the first instance of the PHASE A signal. A logic high state is also latched at circuit point S2 by the FCLR BUS signal. Upon the next transition of the SCLK N and P lines (SCLK P going high, SCLK N going low) this logic high is passed to the FWDOUT line of the end cell 100, providing the initial token to the FWDIN line of the BANK 1 cell 100. The BANK 1 cell 100 is not ready to pass this signal to its F1 NAND gate 112 so no power pulsing occurs for this very first PHASE B period. The sequencing of bank selection for PHASE A and PHASE B power pulses then continues in the fashion described above in the explanation of the bank selection main cell 100. The timing diagram in FIG. 8 shows the interleaved FN signals generated by the bank selection shift register 90 for the first 4 emitter banks 96.

The above explanation of a preferred embodiment of the invention for the case of emitter bank activation by two power pulses can be extended to the case of three or more pulses. In the extended case the ENABLE signal would contain logic transition edges sufficient to define a PHASE period for each pulse and the bank selection shift register 90 would be expanded to pass forward a token for each pulse.

Figure 12:
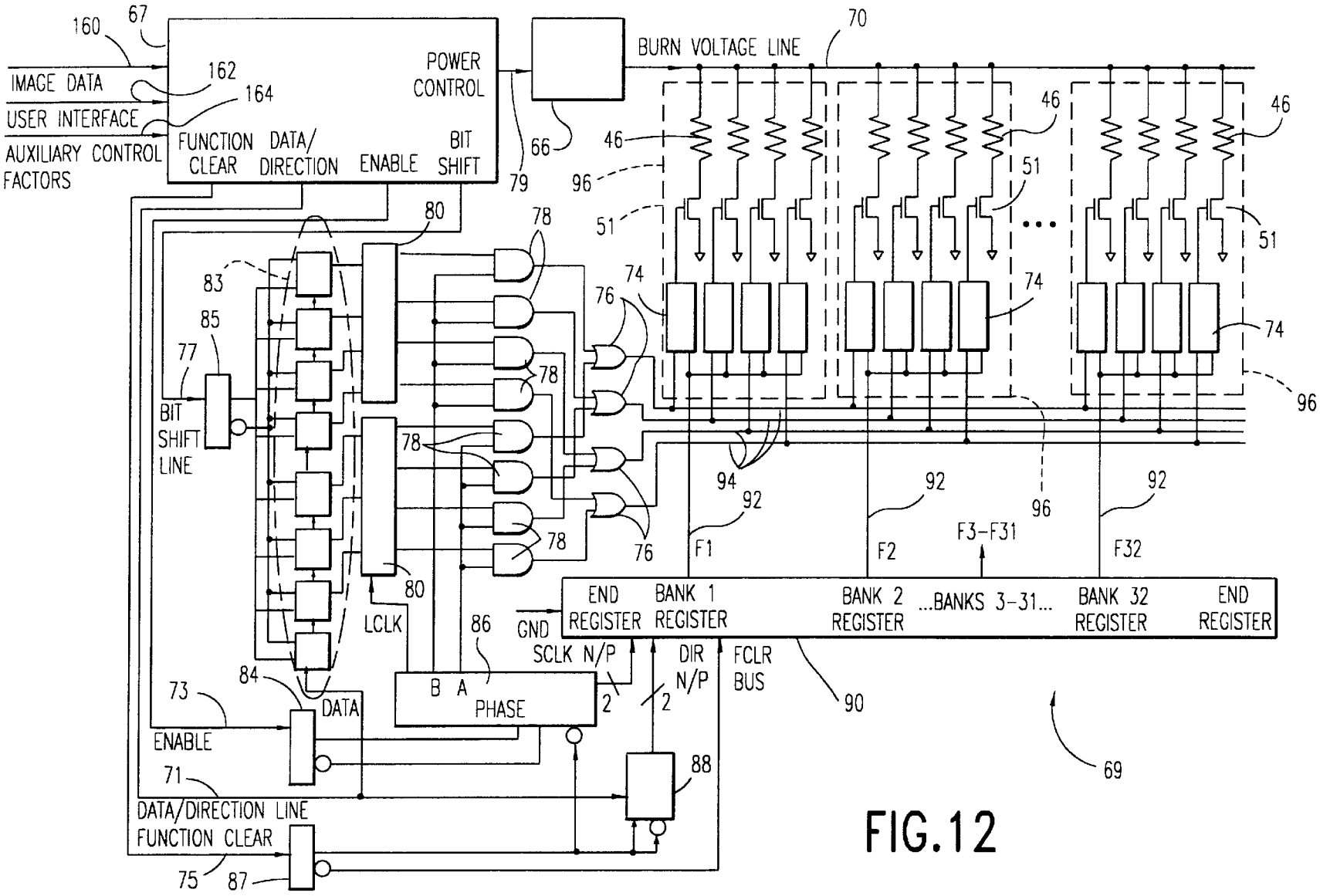
FIG. 12 is a systems diagram illustrating a thermal ink jet printhead, system controller and power source according to a preferred embodiment of the present invention.

A second preferred embodiment of the invention is shown in the system diagram of FIG. 12. The circuit is similar to the embodiment diagrammed in FIG. 7. All like elements of this second embodiment are numbered in like manner to the elements of FIG. 7. There are three differences in this second embodiment all related to enabling the data to control which emitters are pulsed within an emitter bank 96 during PHASE A, in like manner to the previous embodiment, wherein the data controlled the individual emitter pulsing during PHASE B. This new function of allowing PHASE A power pulses only for emitters with corresponding data values of logical 1 (true) is accomplished by expanding the input serial data latch to the 8-bit latch 83, adding a second 4-bit parallel data latch 80 and adding four additional AND gates 78. The AND gates 78 perform the logical operation of ANDING the data presented by the lower 4-bit parallel data latch 80 with the PHASE A signal from the timing generator circuit 86. The outputs of the four lower AND gates are connected to the OR gates 76. In operation 4 bits of DATA are shifted into the lower four cells of 8-bit serial register 83. These bits are loaded into the lower 4-bit parallel data latch 80. They are ANDED with the PHASE A signal so that only signals which are logically DATA AND PHASE A will be presented to the OR gates 76 for presentation to the data lines 94. A next set of 4 bits of DATA is then shifted into 8-bit serial register 83, moving the previous 4 bits of DATA into the upper half of latch 83. These bits are now latched into the upper 4-bit parallel data latch 80. They are now ANDED with the PHASE B signal in the upper four AND gates 78 so that only signals which are logically DATA AND PHASE B are presented to the OR gates 76 for presentation to the data lines 94. In this fashion the DATA for each emitter is preserved during both PHASE A and PHASE B power pulse periods and only emitters which are to be printed receive power from either pulse. This embodiment of the invention therefore has the additional advantage of saving power as well as saving recording time through the interleaving circuitry.

The pulse interleaving circuitry operates exactly the same for this second embodiment as described above for the embodiment diagrammed in FIG. 7. The embodiment of FIG. 12 can also be extended to the case of three or more activation pulses by adding a set of serial and parallel data latches and AND gates for each activation pulse PHASE.

A third embodiment of the invention can be envisioned in which the ENABLE signal logical transition edges are changed by the printer system controller 67 and/or the power applied via the BURN VOLTAGE lines in FIGS. 7 and 12 is changed by the overall printer system controller 67 and the power supply source 66 to further modulate the power being applied to the liquid emitters. In such embodiments, the function of interleaving the pulses in time and controlling some or all of the pulses by the data can be carried out in like fashion to the embodiments described above.

Further, while the preferred embodiment of the invention described above interleave pulses applied to banks of emitters, the preferred embodiments could be easily modified to interleave pulses applied to each emitter.

While this invention has been described in conjunction with specific embodiments thereof, it is evident that many alternatives, modifications and variations will be apparent to those skilled in the art. Accordingly, the preferred embodiments of this invention, as set forth herein, are intended to be illustrative, not limiting. Various changes may be made without departing from the spirit and scope of the invention as defined in the following claims.

What is claimed is:

1. A liquid recording apparatus for forming an image on a recording medium based on image data, comprising:

a power source supplying power pulses, the power pulses including precursor pulses and print pulses;

a recording head having a plurality of liquid emitters each selectively emitting a drop of liquid onto the recording medium in response to one of the print pulses, each print pulse being preceded by one of the precursor pulses; and a control device that selectively connects each of the plurality of liquid emitters to the power source to supply the plurality of power pulses to the liquid emitters, wherein the print pulses supplied to adjacent ones of the emitters have interleaved in time therebetween the precursor pulses supplied to a plurality of succeeding ones of the liquid emitters.

2. The apparatus of claim 1, further comprising means for generating the power pulses based on the image data.

3. The apparatus of claim 1, wherein the liquid emitters each include a heater element and the at least one precursor pulse applied to the heater element causes the heater element to heat liquid adjacent the heater element without emitting a drop of the liquid.

4. The apparatus of claim 1, wherein the liquid emitters each include a heater element and the print pulse applied to the heater element causes at least one drop of liquid to be emitted form the corresponding liquid emitter.

5. The apparatus of claim 1, wherein the liquid emitters are grouped into banks each comprising a plurality of the liquid emitters, and the plurality of power pulses supplied to the liquid emitters within at least a first one of the banks of liquid emitters are interleaved in time with the plurality of power pulses supplied to the liquid emitters within at least a second one of the banks of liquid emitters.

6. The apparatus of claim 5, wherein the control device comprises a shift register that outputs signals which direct the power pulses to the liquid emitters within no more than one of the banks of liquid emitters at any point in time.

7. The apparatus of claim 1, further comprising means for varying a duration of the power pulses based on at least one factor other than the image data.

8. The apparatus according to claims 7, wherein the at least one factor is selected from the group consisting of: a temperature of the liquid, a type of the liquid and a desired size of the drops.

9. The apparatus of claim 1, wherein the recording head and the control device are disposed on an integrated circuit.

10. An ink jet recording apparatus for recording an image onto a recording medium based on image data, comprising:

a power source supplying power pulses, the power pulses including precursor pulses and print pulses;

an ink jet printhead having a plurality of banks of emitters, each of the emitters being selectively activated by one of the print pulses to emit a drop of ink onto the recording medium, each print pulse being preceded by one of the precursor pulses;

data latching circuitry that receives, latches and outputs the image data;

bank grouping circuitry connected to the data latching circuitry that receives the image data and directs the image data to the banks of emitters;

scheduling circuitry that selects no more than one of the banks of emitters during any instant of time and causes the print pulses supplied to adjacent ones of the banks of emitters to have interleaved in time therebetween the precursor pulses supplied to a plurality of succeeding ones of the plurality of banks of emitters.

11. The apparatus of claim 10, further comprising timing circuitry that generates timing signals and power scheduling clock signals, the timing signals defining a printhead cycle time and the power scheduling clock signals defining a plurality of subunits of time within the printhead cycle time, the power scheduling clock signals having a plurality of phases, wherein the timing signals are directed to the data latching circuitry and the power scheduling clock signals are directed to the scheduling circuitry.

12. The apparatus of claim 10, further comprising means for generating the power pulses based on the image data.

13. The apparatus of claim 13, wherein the emitters each include a heater element and the at least one precursor pulse applied to the heater element causes the heater element to heat liquid adjacent the heater element without emitting a drop of the ink.

14. The apparatus of the claim 13, wherein the print pulse applied to the heater element causes at least one drop of ink to be emitted from emitters within a corresponding bank of emitters.

15. The apparatus of claim 10, further comprising means for varying a duration of the power pulses based on at least one factor other than the image data.

16. The apparatus according to claim 15, wherein the at least one factor is selected from the group consisting of: a temperature of the ink, a type of the ink and a desired size of the drops.

17. A method of forming an image on a recording medium based on image data, comprising the steps of:

providing a plurality of pulses including precursor pulses and print pulses; and selectively directing the plurality of pulses to at least one of a plurality of liquid emitters disposed on a recording head, the liquid emitters each emitting a drop of liquid in response to one of the print pulses;

wherein the print pulses supplied to adjacent ones of the emitters have interleaved in time therebetween the precursor pulses supplied to a plurality of succeeding ones of the liquid emitters.

18. The method of claim 17, further comprising the step of generating the plurality of power pulses based on the image data.

19. The method of claim 17, wherein the print pulse causes at least one drop of liquid to be emitted from a corresponding liquid emitter.

20. The method of claim 17, further comprising the step of varying a duration of the power pulses based on at least one factor other than the image data.

21. The method of claim 20, wherein the at least one factor is selected from the group consisting of: a temperature of the liquid, a type of the liquid and a desired size of the drops.

22. A method of forming an image on a recording medium based on image data by emitting droplets of liquid from a plurality of liquid emitters onto the recording medium, each of the droplets emitted from one of the liquid emitters in response to one of a plurality of print pulses, the method comprising:

generating a plurality of precursor pulses and the print pulses; and interleaving in time between adjacent ones of the print pulses the precursor pulses supplied to a plurality of succeeding ones of the liquid emitters.

23. The method of claim 22, wherein the print pulse causes at least one drop of liquid to be emitted from a corresponding liquid emitter.

24. The method of claim 22, further comprising the step of varying a duration of the power pulses based on at least one factor other than the image data.

25. The method of claim 24, wherein the at least one factor is selected from the group consisting of: a temperature of the liquid, a type of the liquid and a desired size of the drops.

* * * * *